United States Patent [19]

Pearson

[11] Patent Number: 4,963,049

[45] Date of Patent: Oct. 16, 1990

[54] BUSINESS CARD FILING ATTACHMENT

[76] Inventor: Herbert C. Pearson, 5429 Mohican Rd., Bethesda, Md. 20816

[21] Appl. No.: 324,712

[22] Filed: Mar. 17, 1989

[51] Int. Cl.[5] ..... B42F 19/04

[52] U.S. Cl. ..... 402/79; 40/360

[58] Field of Search ..... 40/360, 377, 404; 402/79, 80 R, 80 P

[56] References Cited

U.S. PATENT DOCUMENTS 2,847,776 8/1958 Robertson ..... 40/360 X 4,127,690 11/1978 Schleifenbaum et al. ..... 40/360 X 4,643,452 2/1987 Chang ..... 402/79 X 4,713,901 12/1987 Wells et al. ..... 402/79 X 4,849,056 7/1989 Ristuccia, Sr. ..... 402/79

*Primary Examiner*—Paul A. Bell

*Attorney, Agent, or Firm*—Edmund M. Jaskiewicz

[57] ABSTRACT

A business card filing attachment comprises an elongated strip of flat clear plastic material and has a pair of contiguous opposed flanges along one longitudinal edge between which a business card is inserted. Along the other longitudinal edge are formed a pair of openings spaced and shaped for attaching to a card index file.

9 Claims, 1 Drawing Sheet

BUSINESS CARD FILING ATTACHMENT

The present invention relates to the filing and displaying of business cards, more particularly, to an attachment for filing business cards in a card index file without defacing or punching holes in the cards.

Various forms of file card systems have been proposed for retaining, selectively displaying and retrieving information such as names of individuals or companies, addresses, telphone numbers and the like. Such file card systems are generally provided with specially shaped cards which may be readily inserted or removed from the system. It is therefore necessary to remove a particular card from the file, print or type the information upon the card and reinsert the card back into the card file index. When a person receives a business or calling card and desires to retain the information, it is then necessary to place this information on an index card in the manner as described above.

In order to avoid the transfer of information from a business card to a specialized index card, it has been proposed to provide attachments for the business cards so the card and attachment can be inserted into a file card index. One form of such attachment comprises a relatively flat member having two openings in one side thereof for mounting in a rotary card file index or rolodex. The flat member has an adhesive thereon covered by a protective strip which is removed to permit a business card to be adhered to the flat member and thus inserted into a file. Such attachments are disclosed in U.S. Pat. Nos. 4,643,452 and 4,713,901. However, these attaching strips have the disadvantage that the making of such attaching strips requires the application of an adhesive and the application of a protective peel-off covering. Further, the use of an adhesive is not generally satisfactory since problems may be encountered in removing an adhered business card from the attaching strip. If such a business card is removed it may be marked or defaced by the presence of the adhesive. Further, the necessity for removing the protective strips and then adhering the business cards to the adhesive may deter the prompt and accurate filing of business cards in a desired card index file.

It is therefore the principal object of the present invention to provide a novel and improved attaching strip for the filing of business cards in a card index file.

It is another object of the present invention to provide a strip which may be readily attached to a business card without the necessity of defacing or punching holes in the card.

It is a further object of the present invention to provide a simple, inexpensive and effective accessory for the filing of business cards in a rotary or rolodex card file index.

It is still another object of the present invention to provide a process for the economical manufacture of a filing attachment for business cards.

According to one aspect of the present invention a business card filing attachment may comprise an elongated srip of flat material having a length substantially equal to that of a business card. In one longitudinal edge of the strip there is a pair of openings having predetermined shapes and spacing there between for attaching to a card index file. A pair of contiguous opposed flanges are provided on the other longitudinal edge of the elongated strip. These flanges have sufficient rigidity and resiliancy to provide good frictional engagement with respect to a business card inserted there between.

Such a business card filing attachment may be made by bonding two similar elongated strips of flat resiliant material in face-to-face relation except for along one longitudinal edge so as to define a pair of contiguous opposed flanges between which a business card can be inserted. In the other longitudinal edge there is formed a pair of openings having predetermined spacing there between and shaped for attaching to a card index file.

Other objects and advantages of the present invention will be apparent upon reference to the accompanying drawings, which are exemplary, wherein.

Proceeding next to the drawings wherein like reference symbols indicate the same parts throughout the various views a specific embodiment and modifications of the present invention will be described in detail.

Figure 1:
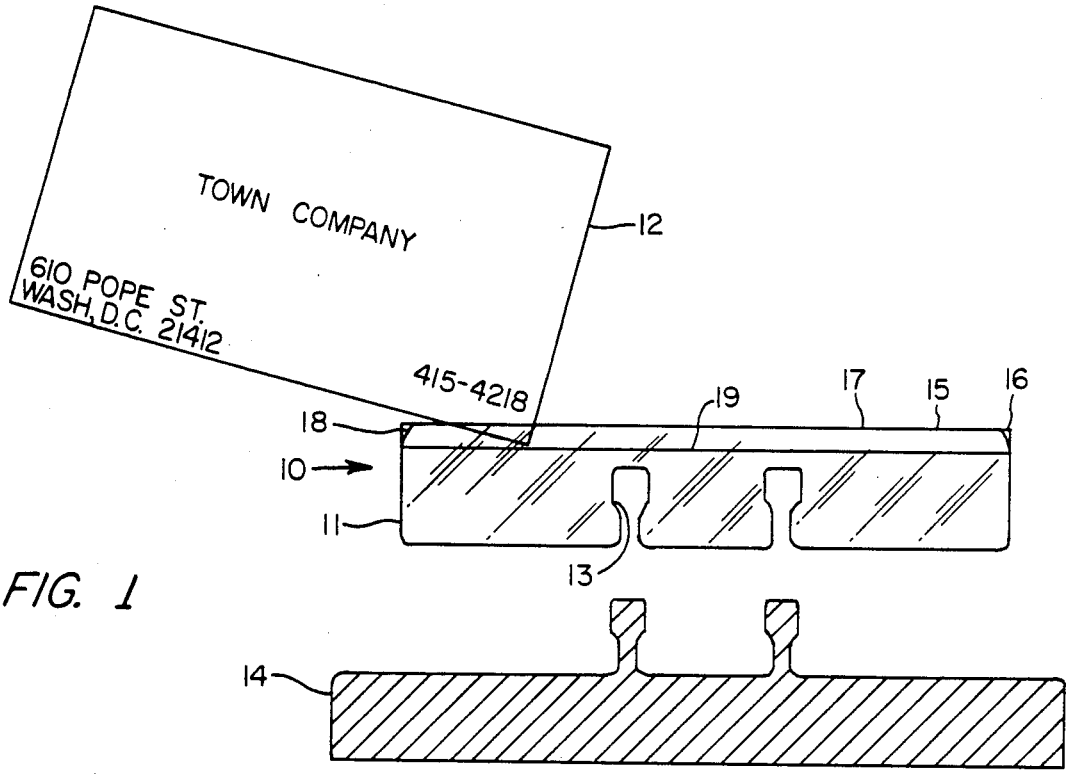
FIG. 1 is an exploded view of a business card and the filing attachment according to the present invention and a section of a business card index file.

As may be seen in FIG. 1, a business card filing attachment according to the present invention is indicated generally at 10 and comprises an elongated strip of flat material 11 which is preferably formed from a transparent plastics material such as a polymer or the like. The strip 11 has a length substantially equal to that of a conventional business card 12 but may be shorter or longer than the card depending on the specific application. The thickness of the strip 11 is substantially twice that or less than the thickness of the business card.

Along one longitudinal edge of the elongated strip 11 are two specially punched holes 13 whose shapes and spacing correspond to a card index file a portion of which is shown at 14. This card index file may be of the rotary or rolodex type as known in the filing art. The card index file 14 is a portion of rotary wheel file as known in the art which retains a multiplicity of file or index cards each of which can be made readily visible to the user.

Along the other longitudinal edge of the elongated strip 11 there is a pair of contiguous opposed flanges 15 and 16 having free ends 17 which are directed away from the strip so as to form a channel or groove between the flanges into which a business card is inserted as seen in FIG. 1. The flanges have sufficient rigidity and resiliancy to provide good frictional engagement with respect to a business card, such as at 12, inserted there between. The flanges 15 and 16 may be actually touching in contact or in close proximity without actually touching.

Although the flanges 15 and 16 are of the same length as the elongated strip 11 the corners of one of the flanges, such as 15, may be rounded as shown at 18 in order to facilitate insertion of the card 12 between the flanges.

Figure 2:
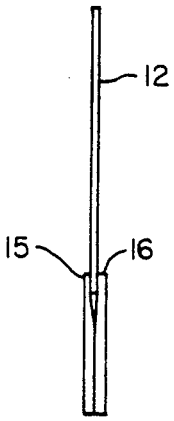
FIG. 2 is a side elevational view of a business card inserted into the filing attachment.
Figure 3:
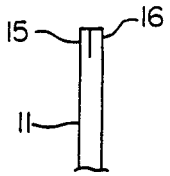
FIG. 3 is a side elevational view of a modification of the filing attachment wherein the flanges and strip are integral.

The filing attachment 10 is preferably made by bonding or molding two flat sheets of suitable transparent plastics material each of which has the shape as seen in FIG. 1. These members are bonded or molded in such a manner up to a line 19 such that the free edges of the members form the flanges 15 and 16. The resulting filing attachment will appear as seen in FIG. 2. However, it is possible to form the filing attachment 10 as a single unitary integral member such as shown in FIG. 3 wherein the flanges 15 and 16 are formed along one longitudinal edge of the strip 11.

After the flat members have been molded together as described above, the openings 13 are then formed in the bonded or molded longitudinal edge by punching or some other suitable process known in the art.

While the filing attachment of the present invention is primarily intended for the filing of business or calling cards, the attachment may be made in other sizes so as to be attached to other card like members such as the known 3×5 or other sized index cards. Also, while in the usual rotary file the cards are mounted substantially horizontally, the filing attachments could also be used for mounting in a rotary file or card file index in a vertical position.

It is readily apparent that the advantage of the filing attachment of the present invention is that it is not necessary to use any kind of adhesives, punches or extraneous clip apparatus in order to adapt a business card for filing in a rolodex file. In addition, vital information along the bottom edges of business cards can be easily seen when the card is in the file because the filing attachment is preferably made of a transparent or clear plastic. However, for particular applications the filing attachment may be made in various colors.

Figure 4:
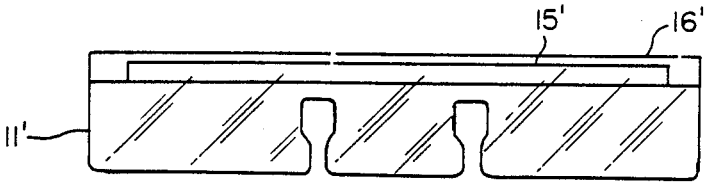
FIG. 4 is a plan view of a modified filing attachment.

In FIG. 4 there is shown a modification of the filing attachment wherein the elongated strip 11' is formed with flanges 15' and 16' which are of unequal lengths and height such that the flange 16' is in overlapping position with respect to the flange 15'. Such differences in the lengths and widths of the flanges also facilitates the insertion of a business card there between.

Thus it can be seen that the present invention has disclosed a business card filing device which enables business cards to be readily filed in a rolodex card file index without defacing or mutilating the business cards in any way. Further, the filed cards can be easily retrieved from the file and all of the information on a card is always clearly visible when the card is moved into a display position. The simple construction and process for making such a filing attachment insures an extremely low production cost of an item which precisely and reliably performs the function of filing business cards.

It will be understood that this invention is susceptible to modifcation in order to adapt it to different usages and conditions, and accordingly, it is desired to comprehend such modifications within this invention as may fall within the scope of the appended claims.

What is claimed is:

1. A business card filing attachment for a card index file comprising an elongated strip of flat material having a pair of substantially parallel longitudinal edges and having a length substantially equal to that of a business card, there being a pair of openings in one of said longitudinal edges having predetermined shapes and spacing there between for attaching to a card index file, and a pair of contiguous opposed flanges on the other of said longitudinal edges of said elongated strip having outer free edges and having sufficient rigidity and resiliancy to provide good frictional engagement with respect to a business card inserted there between.

2. A business card filing attachment as claimed in claim 1 wherein said strip and flanges comprise a unitary integral member.

3. A business card filing attachment as claimed in claim 1 wherein said flanges are coextensive with the length of said strip.

4. A business card filing attachment as claimed in claim 1 wherein said attachment comprises a pair of like flat members bonded over the area outward of said flanges.

5. A business card filing attachment as claimed in claim 1 wherein said attachment comprises a transparent plastic material.

6. A business card filing attachment as claimed in claim 1 wherein said flanges are coextensive.

7. A business card filing attachment as claimed in claim 1 wherein one of said flanges protrudes further from said strip than the other so as to define overlapping flanges.

8. A business card filing attachment as claimed in claim 1 wherein said flanges have unequal lengths.

9. A business card filing attachment as claimed in claim 1 wherein said flanges are identical.

* * * * *